US007506868B2

(12) United States Patent
Oota et al.

(10) Patent No.: US 7,506,868 B2
(45) Date of Patent: Mar. 24, 2009

(54) SHEET FEEDER

(75) Inventors: Ryuichi Oota, Kinokawa (JP); Hideki Oiwa, Kinokawa (JP); Akira Wada, Kinokawa (JP)

(73) Assignee: Duplo Seiko Corporation, Kinokawa-Shi, Wakayama (JP)

( * ) Notice: Subject to any disclaimer, the term of this patent is extended or adjusted under 35 U.S.C. 154(b) by 0 days.

(21) Appl. No.: 10/584,452

(22) PCT Filed: Feb. 28, 2005

(86) PCT No.: PCT/JP2005/003293

§ 371 (c)(1),
(2), (4) Date: Jun. 22, 2006

(87) PCT Pub. No.: WO2005/118442

PCT Pub. Date: Dec. 15, 2005

(65) Prior Publication Data

US 2007/0108692 A1 May 17, 2007

(30) Foreign Application Priority Data

Jun. 2, 2004 (JP) ..... 2004-164384

(51) Int. Cl.
*B65H 3/52* (2006.01)

(52) U.S. Cl. ..... 271/124

(58) Field of Classification Search ..... 271/13, 271/10.03, 251, 94, 98, 104, 124, 138
See application file for complete search history.

(56) References Cited

U.S. PATENT DOCUMENTS 2,249,504 A * 7/1941 Trydal ..... 271/13

FOREIGN PATENT DOCUMENTS

| | | | |
|---|---|---|---|
| DE | 1 267 012 | | 4/1968 |
| EP | 0598272 | * | 5/1994 |
| EP | 0 933 318 | | 8/1999 |
| JP | 59-108631 A | | 6/1984 |
| JP | 60-67343 | * | 4/1985 |
| JP | 60-171939 A | | 9/1985 |
| JP | 64-53948 | * | 3/1989 |
| JP | 1-133837 | * | 5/1989 |

(Continued)

OTHER PUBLICATIONS

International Search Report dated May 10, 2005.

(Continued)

*Primary Examiner*—Patrick H Mackey
*Assistant Examiner*—Thomas A Morrison
(74) *Attorney, Agent, or Firm*—Buchanan Ingersoll & Rooney PC

(57) ABSTRACT

A sheet feeder is characterized by comprising a suction carrying means, an oblique carrying means, a handling member, a detecting means located downstream of the handling member and for detecting a sheet passing through the handling member, and a retracting mechanism for retracting the handling member from the sheet passing through while the detecting means is detecting the sheet passing through.

7 Claims, 4 Drawing Sheets

FOREIGN PATENT DOCUMENTS

| | | | |
|---|---|---|---|
| JP | 2-142046 | | 11/1990 |
| JP | 10-167504 | * | 6/1998 |
| JP | 11-334901 A | | 12/1999 |
| JP | 2000-010370 | | 1/2000 |
| JP | 2000-034052 | | 2/2000 |
| JP | 2000-034052 A | | 2/2000 |
| JP | 2001-232700 A | | 8/2001 |

OTHER PUBLICATIONS

Supplementary European Search Report dated Jul. 4, 2007.
English translation of Japanese Office Action dated Jul. 22, 2008 in corresponding Japanese application No. 2004-164384.

* cited by examiner

SHEET FEEDER

TECHNICAL FIELD

The present invention relates to a sheet feeder for separating sheets one by one from sheets piled on a sheet feeding table, and for carrying the sheets.

BACKGROUND ART

For example, Patent Document 1 discloses a sheet processor. In this sheet processor, sheets are carried and fed to a processor body one by one, by a sheet feeder. And in the processor body, the sheet is processed by being cut and/or folded in a carrying direction, or in a direction perpendicular to the carrying direction, while the sheets are being carried. Also, for example, Patent Document 2 discloses a technique that sheets are sucked and carried one by one in a sheet feeder. Further, for example, Patent Document 3 discloses a technique that a handling member is positioned in a handling location when a sheet feeding cassette is in a sheet feeding position, and that the handling member is retracted from the handling location when the sheet feeding cassette is not in the sheet feeding position.

Patent Document 1: Japanese Laid-Open Patent Publication No. 2001-232700

Patent Document 2: Japanese Laid-Open Patent Publication No. 2000-34052

Patent Document 3: Japanese Laid-Open Patent Publication No. H11-334901

DISCLOSURE OF INVENTION

Problem to Be Solved by the Invention

In the sheet processor of the Patent Document 1, for example, the process for cutting a sheet in the carrying direction, is made with reference to an edge of the sheet. Therefore, in each of the sheet feeders of Patent Documents 1 and 2, the sheet is fed with an edge thereof being positioned along a guide wall.

FIG. 3 is a plan view showing such a sheet feeder as aforementioned. This sheet feeder has a construction in which the sheet is fed with the edge thereof being positioned along the guide wall. The sheet feeder is composed of a suction carrying means 2 locating in the upstream side in the carrying direction (i.e. a direction of an arrow "A") and an oblique carrying means 3 locating in the downstream side in the same direction, in which the suction carrying means 2 and the oblique carrying means 3 are integrated to each other. FIG. 4 is a vertical sectional diagrammatical view showing a conventional sheet feeder, and this figure corresponds to a sectional view taken on a line IV-IV in FIG. 3. The suction carrying means 2 sucks up an uppermost sheet 10 locating on top of the sheets 10 which are piled on a sheet feeding table 11, and then the means 2 carries the sheet 10 from the upstream side to the downstream side in the carrying direction. The oblique carrying means 3 carries the sheet 10 on the oblique carrying means 3. The oblique carrying means 3 carries the sheet 10 slantingly toward the guide wall 31, in order to position the edge of the sheet 10 along the guide wall 31. Further, the oblique carrying means 3 carries the sheet 10 downstream in the carrying direction. There is provided a handling member 4 below of the downstream side of the suction carrying means 2. The handling member 4 allows only the uppermost sheet 10 carried by the suction carrying means 2 to pass through it.

In the above conventional sheet feeder, when the sheet 10 passes through the handling member 4 and starts to be carried on the oblique carrying means 3, the sheet 10 still contacts the handling member 4, as shown in FIG. 4. The condition thereof continues until a rear end 102 of the sheet 10 passes through the handling member 4. In case that the sheet 10 is kept to contact the handling member 4, the handling member 4 becomes a hindrance to the sheet 10, and therefore the sheet 10 on the oblique carrying means 3 can not be carried smoothly. As a result, there arises a problem that the sheet 10 is fed from the sheet feeder before the edge of the sheet 10 gets to be positioned along the guide wall 31.

Also, in the sheet feeder of Patent Document 3, the handling member is all the time positioned in the handling location when the sheet is fed. Therefore, there arises a problem similar to that as aforementioned.

The object of the present invention is to provide a sheet feeder, in which when the sheet which is passing through the handling member 4, is carried slantingly toward the guide wall 31 by the oblique carrying means 3, the handling member 4 is prevented from becoming a hindrance to the carrying, and therefore a smooth carrying by the oblique carrying means 3 is realized.

Means for Solving the Problem

The present invention has a characterization that there are provided a detecting means and a retracting mechanism, in a sheet feeder that has a suction carrying means, an oblique carrying means and a handling member, and that separates sheets one by one from top of sheets piled up on a sheet feeding table and then carries the sheets. The suction carrying means sucks an uppermost sheet of sheets piled up and carries the uppermost sheet from the upstream side to the downstream side in a carrying direction. The oblique carrying means is a means for carrying the sheet on the oblique carrying means, in which the oblique carrying means locates in the downstream side of the suction carrying means, in which the oblique carrying means carries the sheet slantingly toward a guide wall in order to position an edge of the sheet along the guide wall, and in which the oblique carrying means carries the sheet downstream in the carrying direction. The handling member allows only the uppermost sheet carried by the suction carrying means to pass through the handling member. The detecting means detects the sheet which is passing through the handling member, in which the detecting means locates downstream of the handling member. And the retracting mechanism retracts the handling member from the sheet passing through the handling member while the detecting means is detecting the sheet passing through.

Effects of the Invention

In the present invention, while the detecting means is detecting the sheet which is passing through the handling member, the retracting mechanism retracts the handling member from the sheet passing through. Therefore, according to the present invention, when the sheet passing through is carried slantingly toward the guide wall by the oblique carrying means, it is prevented that the handling member becomes a hindrance to the carrying and therefore a smooth carrying by the oblique carrying means is realized. That is, according to the present invention, the sheet can be carried smoothly by the oblique carrying means, without interference by the handling member. Accordingly, the present invention can solve the problem that the sheet with one edge thereof being not positioned along the guide wall is fed from the sheet feeder. Consequently, the present invention can assure that the sheet after feeding is processed accurately by the processor body.

DESCRIPTION OF THE REFERENCE NUMERALS

Figure 1:
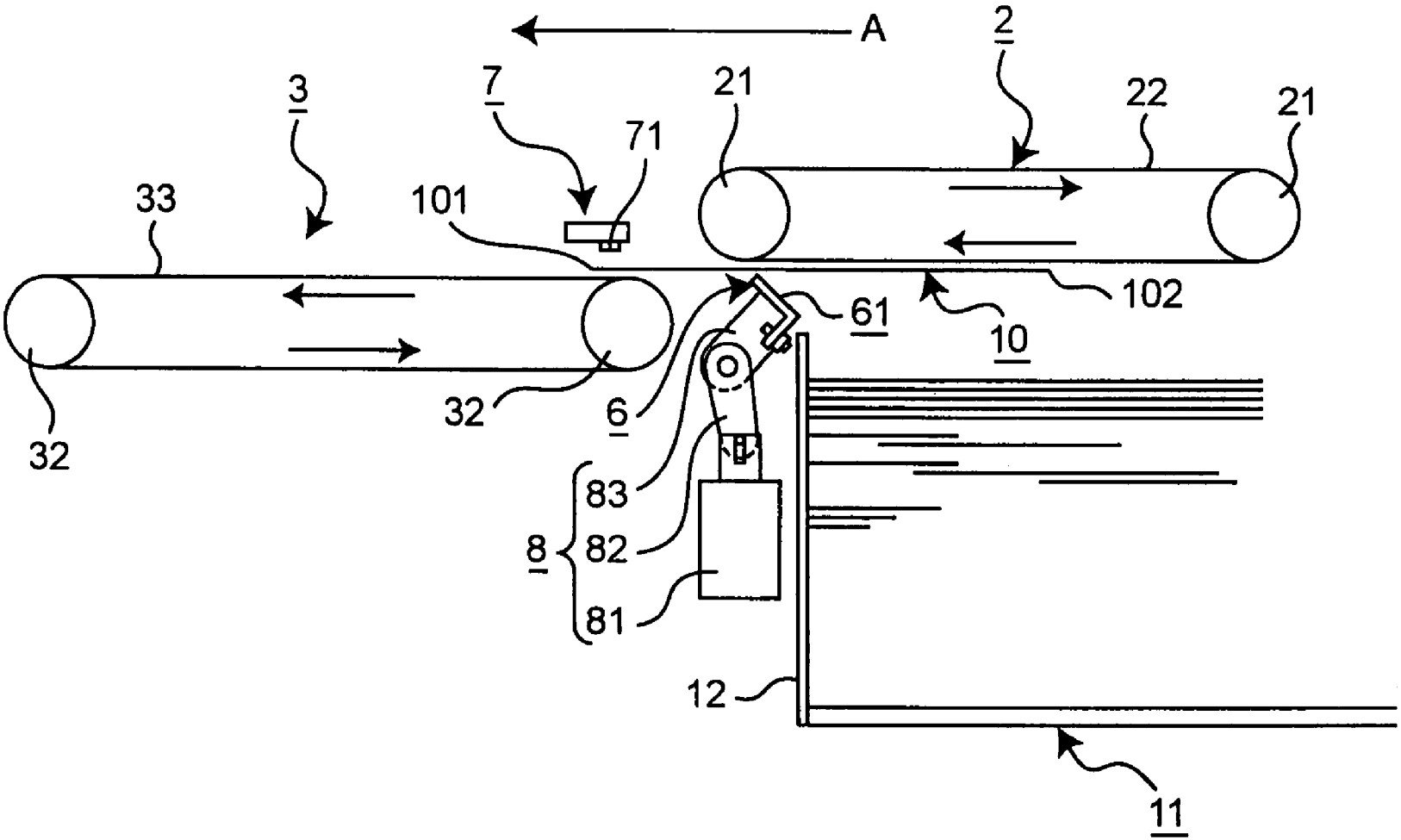
FIG. 1: It is a vertical sectional diagrammatical view showing a sheet feeder according to the present invention, and it corresponds to a sectional view taken on a line I-I in FIG. 3.

2 Suction carrying means
3 Oblique carrying means
31 Guide wall
6 Handling member
7 Detecting means
8 Retracting mechanism

Best Mode for Carrying out the Invention

Figure 3:
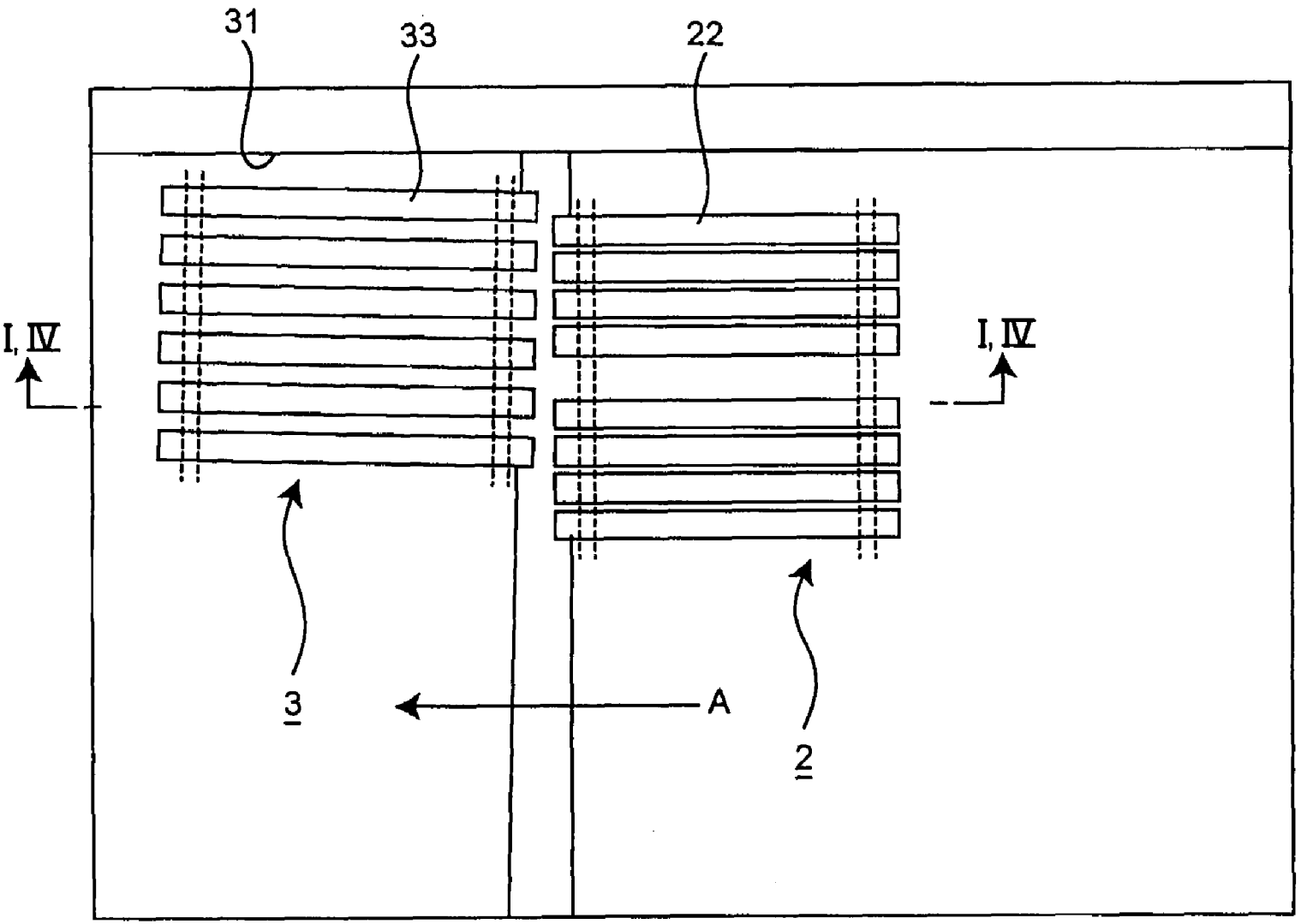
FIG. 3: It is a plan view showing the sheet feeder.
Figure 4:
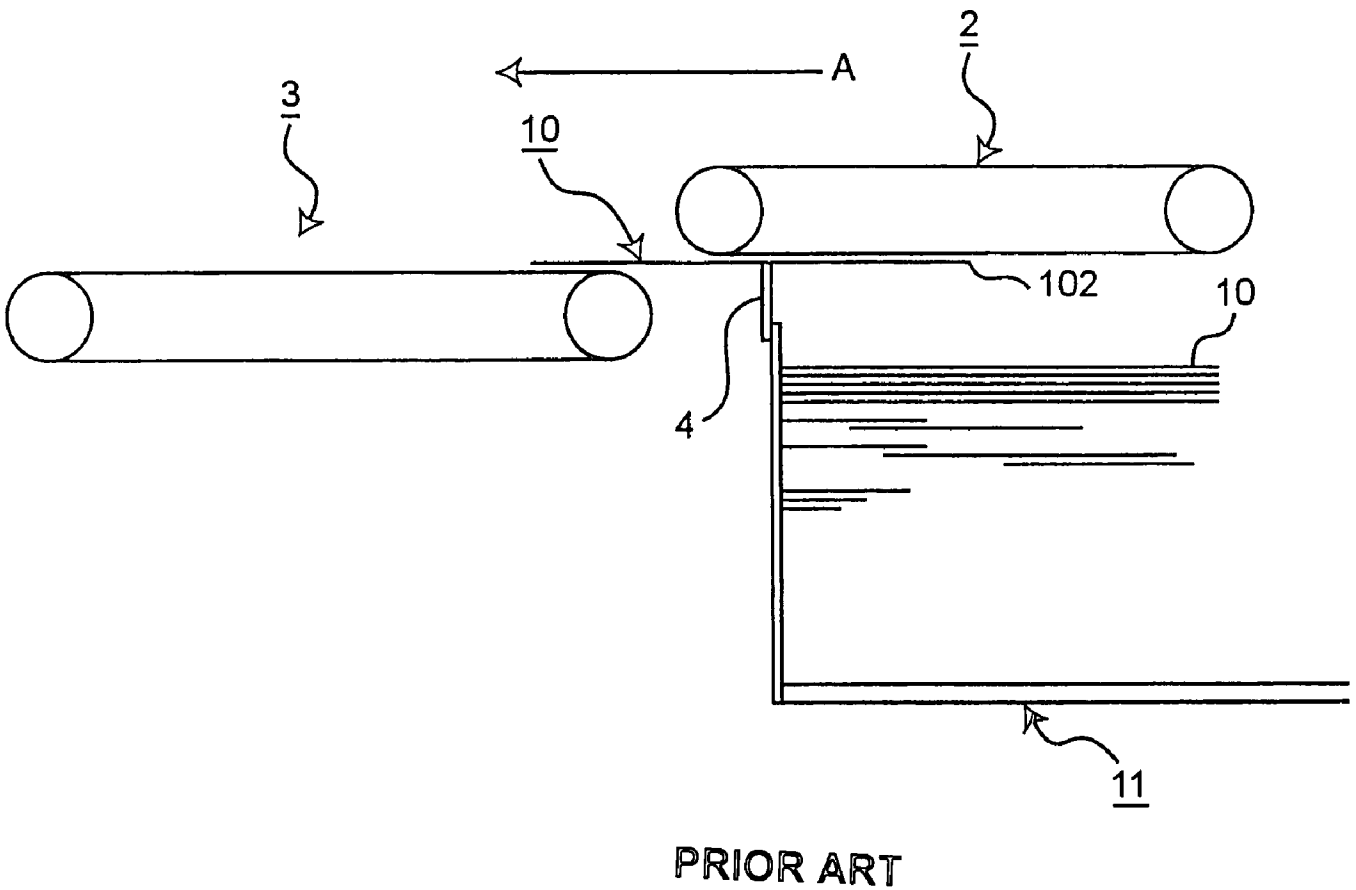
FIG. 4: It is a vertical sectional diagrammatical view showing a conventional sheet feeder, and it corresponds to a sectional view taken on a line IV-IV in FIG. 3.

FIG. 1 is a vertical sectional diagrammatical view showing a sheet feeder according to the present invention, and it corresponds to a sectional view taken on a line I-I in FIG. 3. In FIGS. 1 and 4, the same reference numerals indicate the same or corresponding components. The sheet feeder according to the present invention has a suction carrying means 2 locating in the upstream side in a carrying direction (i.e. a direction of an arrow "A") and an oblique carrying means 3 locating in the downstream side in the same direction, in which the suction carrying means 2 and the oblique carrying means 3 are integrated to each other.

More specifically, the sheet feeder of the present invention has the suction carrying means 2, an air blowing means (not shown), a handling member 6, and the oblique carrying means 3. The suction carrying means 2 sucks up an uppermost sheet 10 locating on top of sheets 10 which are piled on a sheet feeding table 11, and then the means 2 carries the sheet 10 from the upstream side to the downstream side in the carrying direction. The air blowing means blows air toward front edges 101 of the downstream side of the sheets 10 piled up, from its downstream side. The handling member 6 allows only the uppermost sheet 10 which is carried by the suction carrying means 2 to pass through it. The oblique carrying means 3 carries the sheet 10 on the oblique carrying means 3. The oblique carrying means 3 carries the sheet 10 slantingly toward the guide wall 31, in order to position an edge of the sheet 10 along the guide wall 31, and the oblique carrying means 3 carries the sheet 10 downstream in the carrying direction. Incidentally, the sheets 10 are piled up on the sheet feeding table 11. Also, the front edges 101 of the sheets 10 contact an end wall 12 of the downstream side of the sheet feeding table 11.

The suction carrying means 2 has an endless annular belt 22 and a suction means (not shown). The belt 22 extends between a pair of rotation rollers 21. The suction means sucks up the sheet 10 below the belt 22 and makes the sheet 10 be sucked to the belt 22. The suction carrying means 2 carries the sheet 10 downstream in accordance with the movement of the belt 22 in the direction of an arrow, in a state that the sheet 10 is sucked to the belt 22.

The air blowing means has a blowing part (not shown) which penetrates the end wall 12, and an air blower (not shown) which is connected to the blowing part. The air blowing means blows air through the blowing part from the downstream side to the upstream side.

The oblique carrying means 3 carries the sheet 10 having been carried by the suction carrying means 2, on an endless annular belt 33. The belt 33 extends between a pair of rotation rollers 32. The belt 33 is provided slightly slantingly toward the guide wall 31 with respect to the carrying direction. Therefore, in the oblique carrying means 3, the sheet 10 is carried with being pushed to the guide wall 31 side. Consequently, the sheet 10 is carried in the direction of the arrow "A" in a state that an edge of the sheet 10 is positioned along the guide wall 31.

The handling member 6 of the present invention is provided with a detecting means 7 and a retracting mechanism 8.

The handling member 6 has a projection piece 61. The projection piece 61 is arranged above the end wall 12 of the sheet feeding table 11 and below the suction carrying means 2, and the projection piece 61 is arranged in a standing state and tilts toward the carrying direction.

The detecting means 7 has a sensor 71 which is arranged above an end part of the upstream side of the oblique carrying means 3. When the sensor 71 detects the front edge 101 of the sheet 10 which has been carried on the belt 33 of the oblique carrying means 3, it outputs a retract signal to the retracting mechanism 8. And when the sensor 71 detects the rear edge 102 of the sheet 10, it outputs a return signal to the retracting mechanism 8.

Figure 2:
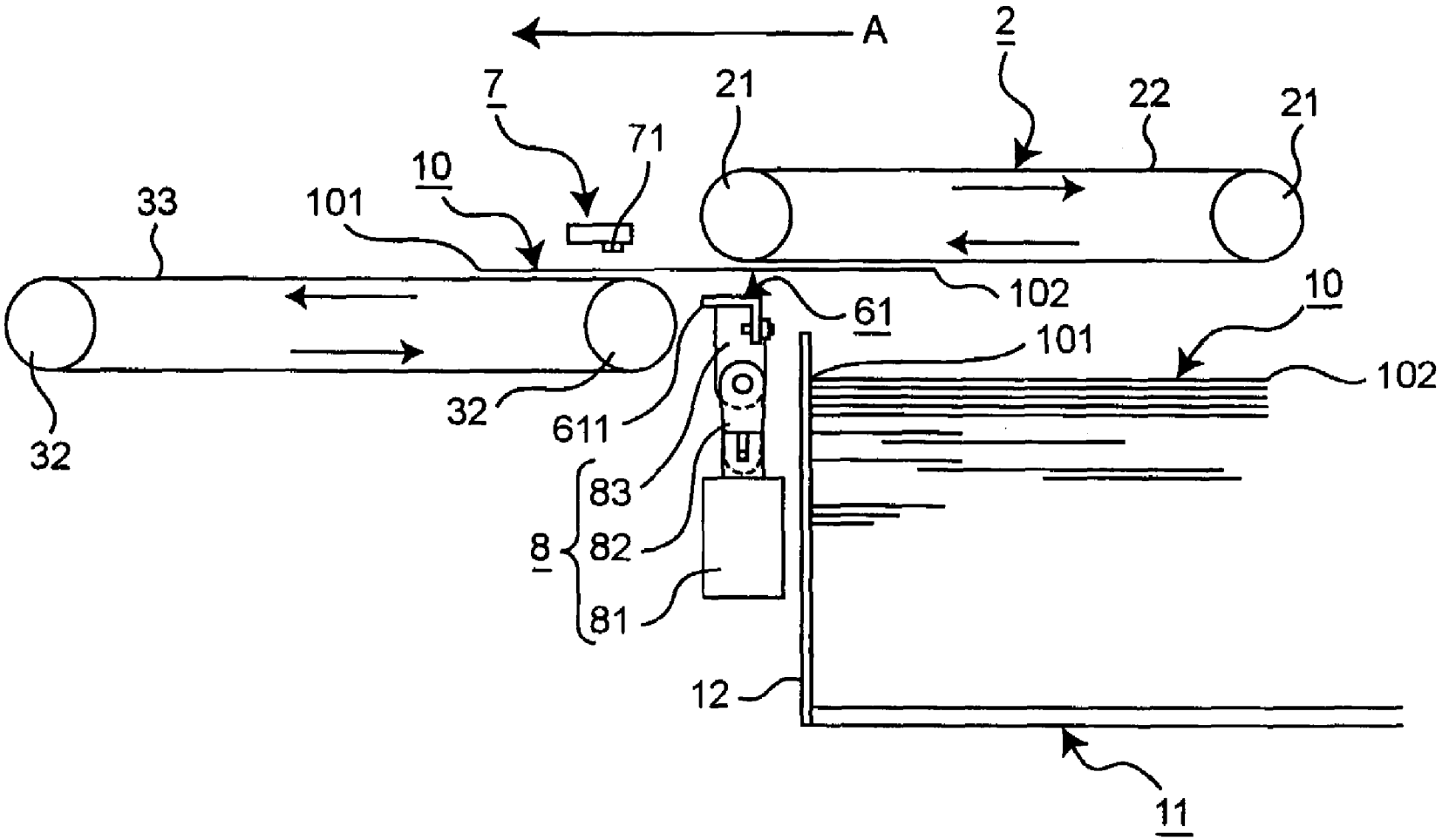
FIG. 2: It is a vertical sectional diagrammatical view showing a condition of operation which follows that shown in FIG. 1.

The retracting mechanism 8 has a piston mechanism 81, a first arm 82 which is linked to the piston mechanism 81, and a second arm 83 which is rotatably connected to the first arm 82. In the retracting mechanism 8, the projection piece 61 is supported on a tip part of the second arm 83. As shown in FIG. 2, when the retracting mechanism 8 receives the retract signal from the sensor 71, the piston mechanism 81 is operated so as to pull down the first arm 82. Thereby, the retracting mechanism 8 makes the posture of the first arm 82 generally upright and therewith rotates the second arm 83 to make the posture of the second arm 83 generally upright. As a result, an edge 611 of the projection piece 61 is lowered in position. Meanwhile, when the retracting mechanism 8 receives the return signal from the sensor 71, the piston mechanism 81 is operated so as to push up the first arm 82. Thereby, the retracting mechanism 8 returns the projection piece 61 back to a condition shown in FIG. 1, which is, namely, a condition for handling the sheet.

Next, it is explained about an operation of the sheet feeder having the above construction.

Firstly, the air blowing means is operated so that air is blown from the blowing part toward an upper part of the sheets 10 piled up on the sheet feeding table 11. Thereby, a gap is formed between adjacent several sheets 10 locating on an upper part thereof, and those sheets 10 are floated from each other, thus making it easy to separate the sheets 10 from each other. In this condition, the suction means of the suction carrying means 2 is operated. Thereby, an uppermost sheet 10 of the several sheets 10 which are subject to easy separation from each other, is sucked up, and the uppermost sheet 10 is sucked to the belt 22. Then, the rotation roller 21 is operated. With this operation, the sheet 10 having been sucked to the belt 22, passes through the handling member 6 and is then carried to the oblique carrying means 3 in accordance with the movement of the belt 22. The oblique carrying means 3 carries the sheet 10 on the belt 33. The oblique carrying means 3 carries the sheet 10 slantingly toward the guide wall 31, and at the same time the oblique carrying means 3 carries the sheet 10 downstream in the carrying direction. Thereby, the sheet 10 is fed in the direction of the arrow "A", in a state that the edge of the sheet 10 is positioned along the guide wall 31.

During the aforementioned operation, as shown in FIG. 1, when the sheet 10 is sucked and carried by the suction carrying means 2, when the sheet 10 passes through the handling member 6, and when the front edge 101 is put on the belt 33 of the oblique carrying means 3, the sensor 71 detects the front edge 101, and the retract signal is sent to the retracting mechanism 8. Receiving the retract signal, the retracting mechanism 8 makes the piston mechanism 81 operate and makes the edge 611 of the projection piece 61 be lowered in position, as shown in FIG. 2. With this operation, the handling member 6 is kept in a state of non-contact with the sheet 10 which is passing through the handling member 6. Consequently, the sheet 10 in which the front edge 101 has been put on the belt 33 of the oblique carrying means 3 is carried smoothly by the oblique carrying means 3, with no interference by the handling member 6. Therefore, according to the sheet feeder having the aforementioned construction, the sheet 10 is fed in the direction of the arrow "A" by the oblique carrying means 3, in a state that the edge of the sheet 10 is positioned surely along the guide wall 31.

When the sensor 71 detects the rear edge 102 of the sheet 10 which has passed through the handling member 6, it outputs the return signal to the retracting mechanism 8. Receiving the return signal, the retracting mechanism 8 makes the piston mechanism 81 operate, as aforementioned, and makes the projection piece 61 be returned to a state for handling the sheet. With this operation, a new sheet 10 is sucked and carried by the suction carrying means 2, and the new sheet 10 passes through the handling member 6.

As mentioned above, according to the sheet feeder having the above construction, while the detecting means 7 is detecting the sheet 10 which is passing through the handling member 6, the retracting mechanism 8 makes the handling member 6 retract from the sheet 10 which is passing through the handling member 6. Therefore, the sheet 10 can be carried smoothly by the oblique carrying means 3, without any interference by the handling member 6. Consequently, according to the sheet feeder having the above construction, the sheet 10 is fed by the oblique carrying means 3, in a state that the edge of the sheet 10 is positioned surely along the guide wall 31.

INDUSTRIAL APPLICABILITY

The sheet feeder of the present invention can feed a sheet, in a state that an edge of the sheet 10 is positioned surely along the guide wall. As a result, exact process of the sheet in a processor body is ensured, and therefore the utility value in industry is large.

The invention claimed is:

1. A sheet feeder having an upstream side and a downstream side, the sheet feeder comprising:

a suction carrier that sucks an uppermost sheet of sheets piled up and carries the uppermost sheet from the upstream side to the downstream side in a carrying direction;

an oblique carrier that carries a sheet, wherein the oblique carrier is located downstream of the suction carrier, wherein the oblique carrier carries the sheet slantingly toward a guide wall in order to position an edge of the sheet along the guide wall, and wherein the oblique carrier carries the sheet downstream in the carrying direction; and a handling member for allowing only the uppermost sheet carried by the suction carrier to pass the handling member, wherein the sheet feeder separates sheets one by one from the sheets piled up on a sheet feeding table and then carries the sheets, wherein there are provided:

a detector located on the sheet feeder at a location for detecting a front edge of the sheet and a rear edge of the sheet which has passed the handling member and has been put on the oblique carrier, wherein the detector is located downstream of the handling member; and a retracting mechanism, wherein the handling member is retracted by the retracting mechanism to a position away from an operative position adjacent the sheet passing the handling member in response to the detector detecting the front edge of the sheet, and wherein the handling member is returnable to the operative position by the retracting mechanism in response to the detector detecting the rear edge of the sheet after the detector detects a front edge of the sheet.

2. The sheet feeder according to claim 1, wherein the retracting mechanism holds the handling member away from the sheet every time the sheet is detected by the detector.

3. The sheet feeder according to claim 1, wherein the retracting mechanism holds the handling member away from the sheet for the entire time that the detector detects the sheet.

4. The sheet feeder according to claim 2, wherein the retracting mechanism holds the handling member away from the sheet for the entire time that the detector detects the sheet.

5. A sheet feeder having an upstream side and a downstream side, wherein the sheet feeder separates sheets one by one from sheets piled up on a sheet feeding table and then carries the sheets, the sheet feeder comprising:

a pickup carrier that picks up an uppermost sheet of sheets piled up and carries the uppermost sheet from the upstream side to the downstream side in a carrying direction;

an oblique carrier that carries a sheet on the oblique carrier, wherein the oblique carrier is located downstream of the pickup carrier, wherein the oblique carrier carries the sheet slantingly toward a guide wall in order to position an edge of the sheet along the guide wall, and wherein the oblique carrier carries the sheet downstream in the carrying direction;

a handling member for allowing only the uppermost sheet carried by the pickup carrier to pass the handling member, a detector located on the sheet feeder at a location for detecting a presence of a sheet which has passed the handling member and has been put on the oblique carrier, wherein the detector is located downstream of the handling member; and a retracting mechanism, wherein the handling member is held away from an operative position adjacent the sheet passing the handling member in response to the detector detecting a front edge of the sheet, and wherein the handling member is returned to the operative position when in response to the detector detecting a rear edge of the sheet after the detector detects the front edge of the sheet.

6. A sheet feeder having an upstream side and a downstream side, the sheet feeder comprising:

a suction carrier that sucks an uppermost sheet of sheets piled up and carries the uppermost sheet from the upstream side to the downstream side in a carrying direction;

an oblique carrier that carries a sheet, wherein the oblique carrier is located downstream of the suction carrier, wherein the oblique carrier carries the sheet slantingly toward a guide wall in order to position an edge of the sheet along the guide wall, and wherein the oblique carrier carries the sheet downstream in the carrying direction; and a handling member for allowing only the uppermost sheet carried by the suction carrier to pass the handling member, wherein the sheet feeder separates sheets one by one from the sheets piled up on a sheet feeding table and then carries the sheets, wherein there are provided:

a detector located on the sheet feeder at a location for detecting a front edge of the sheet and a rear edge of the sheet which has passed the handling member and has been put on the oblique carrier, wherein the detector is located downstream of the handling member; and means for retracting the handling member away from an operative position adjacent the sheet passing the handling member when the detector detects the front edge of the sheet, and returning the handling member to the operative position when the detector detects the rear edge of the sheet after the detector detects the front edge of the sheet.

7. The sheet feeder according to claim 1, wherein the oblique carrier carries the sheet slantingly toward the guide wall in order to position a side edge of the sheet along the guide wall, and wherein retracting mechanism retracts the handling member such that the oblique carrier carries the sheet with no interference by the handling member.

* * * * *